US012061045B2

(12) United States Patent
Day et al.

(10) Patent No.: US 12,061,045 B2
(45) Date of Patent: Aug. 13, 2024

(54) METHOD FOR STARTING UP A CRYOGENIC AIR SEPARATION UNIT AND ASSOCIATED AIR SEPARATION UNIT

(71) Applicants: L'Air Liquide, Societe Anonyme pour l'Etude et l'Exploitation des Procedes Georges Claude, Paris (FR); Eric Day, Hangzhou (CN); Fei Gao, Hangzhou (CN); Huali Xie, Hangzhou (CN)

(72) Inventors: Eric Day, Hangzhou (CN); Fei Gao, Hangzhou (CN); Huali Xie, Hangzhou (CN)

(73) Assignee: L'Air Liquide, Societe Anonyme Pour I'Etude et I'Exploitation des Procedes Georges Claude, Paris (FR)

( * ) Notice: Subject to any disclaimer, the term of this patent is extended or adjusted under 35 U.S.C. 154(b) by 463 days.

(21) Appl. No.: 17/415,688

(22) PCT Filed: Dec. 19, 2018

(86) PCT No.: PCT/CN2018/122047
§ 371 (c)(1),
(2) Date: Jun. 17, 2021

(87) PCT Pub. No.: WO2020/124427
PCT Pub. Date: Jun. 25, 2020

(65) Prior Publication Data

US 2022/0074657 A1 Mar. 10, 2022

(51) Int. Cl.
*F25J 3/04* (2006.01)

(52) U.S. Cl.
CPC ..... *F25J 3/04818* (2013.01); *F25J 3/04054* (2013.01); *F25J 3/04296* (2013.01);
(Continued)

(58) Field of Classification Search
CPC .. F25J 3/04818; F25J 3/04054; F25J 3/04296; F25J 3/04393; F25J 3/04412;
(Continued)

(56) References Cited

U.S. PATENT DOCUMENTS 5,329,776 A * 7/1994 Grenier ..... F25J 3/04412 62/646
5,475,980 A * 12/1995 Grenier ..... F25J 3/04351 62/646

(Continued)

FOREIGN PATENT DOCUMENTS

CN 17 845 80 6/2006
CN 1 873 358 12/2006

(Continued)

OTHER PUBLICATIONS

International Search Report and Written Report for PCT/CN2018/122047, mailed Aug. 20, 2019.

*Primary Examiner* — Jenna M Maroney
(74) *Attorney, Agent, or Firm* — Justin K. Murray

(57) ABSTRACT

In a process for starting up an air separation unit, which is at a temperature of above 0° C., the air separation unit comprising a main air compressor for compressing the feed air, a booster driven by a turbine and a venting conduit connected downstream of the booster and upstream of the main heat exchanger wherein in order to start up the air separation unit, once the turbine is operating at said given speed, the venting conduit is opened to send at least part of the air compressed in the booster from the booster outlet to the atmosphere.

9 Claims, 1 Drawing Sheet

(52) U.S. Cl.
CPC ..... *F25J 3/04393* (2013.01); *F25J 3/04412* (2013.01); *F25J 3/04781* (2013.01); *F25J 2230/08* (2013.01); *F25J 2230/40* (2013.01); *F25J 2240/04* (2013.01); *F25J 2240/10* (2013.01); *F25J 2245/40* (2013.01)

(58) Field of Classification Search
CPC .. F25J 3/04781; F25J 2230/08; F25J 2230/40; F25J 2240/04; F25J 2240/10; F25J 2245/40; F25J 3/04957; F25J 3/04672; F25J 3/0446; F25J 3/044; F25J 3/04375; F25J 3/04357; F25J 3/04345; F25J 3/04315; F25J 3/04309; F25J 3/0429; F25J 3/04284; F25J 3/04278; F25J 3/04236; F25J 3/0423; F25J 3/04218; F25J 3/04133; F25J 3/0406; F25J 3/0403; F25J 2270/90; F25J 2270/02; F25J 2245/50; F25J 2245/42; F25J 2240/12; F25J 2230/24; F25J 2215/50; F25J 2200/94; F25J 2200/72; F25J 2200/06; F25J 3/04787; F25J 3/04303; F25J 3/04084; F25J 2290/62; F25J 3/04024; F25J 2240/42; F25J 2235/50; F25J 2230/20; F25J 2205/04; F25J 3/04812; F25J 3/04381; F25J 3/04175; F25J 3/042; F25J 3/0409; F25J 3/04763; F25J 3/04478; F25J 3/0295; F25J 3/04; F25J 3/0695
See application file for complete search history.

(56) References Cited

U.S. PATENT DOCUMENTS

| | | | | |
|---|---|---|---|---|
| 5,533,339 | A * | 7/1996 | Clare | F25J 3/0409 62/924 |
| 5,806,341 | A * | 9/1998 | Rathbone | F25J 3/04412 62/646 |
| 5,809,802 | A * | 9/1998 | Rathbone | F25J 3/04678 62/646 |
| 6,871,513 | B2 * | 3/2005 | Guillard | F25J 3/04824 62/648 |
| 7,272,954 | B2 * | 9/2007 | Brugerolle | F25J 3/0409 62/649 |
| 7,464,568 | B2 | 12/2008 | Le Bot et al. | |
| 2006/0272353 | A1 | 12/2006 | Prasad | |
| 2008/0223076 | A1 * | 9/2008 | Le Bot | F25J 3/04466 62/646 |
| 2012/0118006 | A1 * | 5/2012 | Judas | F25J 3/0409 62/606 |
| 2015/0168057 | A1 | 6/2015 | Musicus | |
| 2015/0345857 | A1 * | 12/2015 | Rauch | F25J 3/04781 62/615 |
| 2018/0180357 | A1 | 6/2018 | Golubev | |

FOREIGN PATENT DOCUMENTS

| | | |
|---|---|---|
| CN | 2012 81522 | 7/2009 |
| CN | 103 776 240 | 5/2014 |
| CN | 108 253 732 | 7/2018 |

* cited by examiner

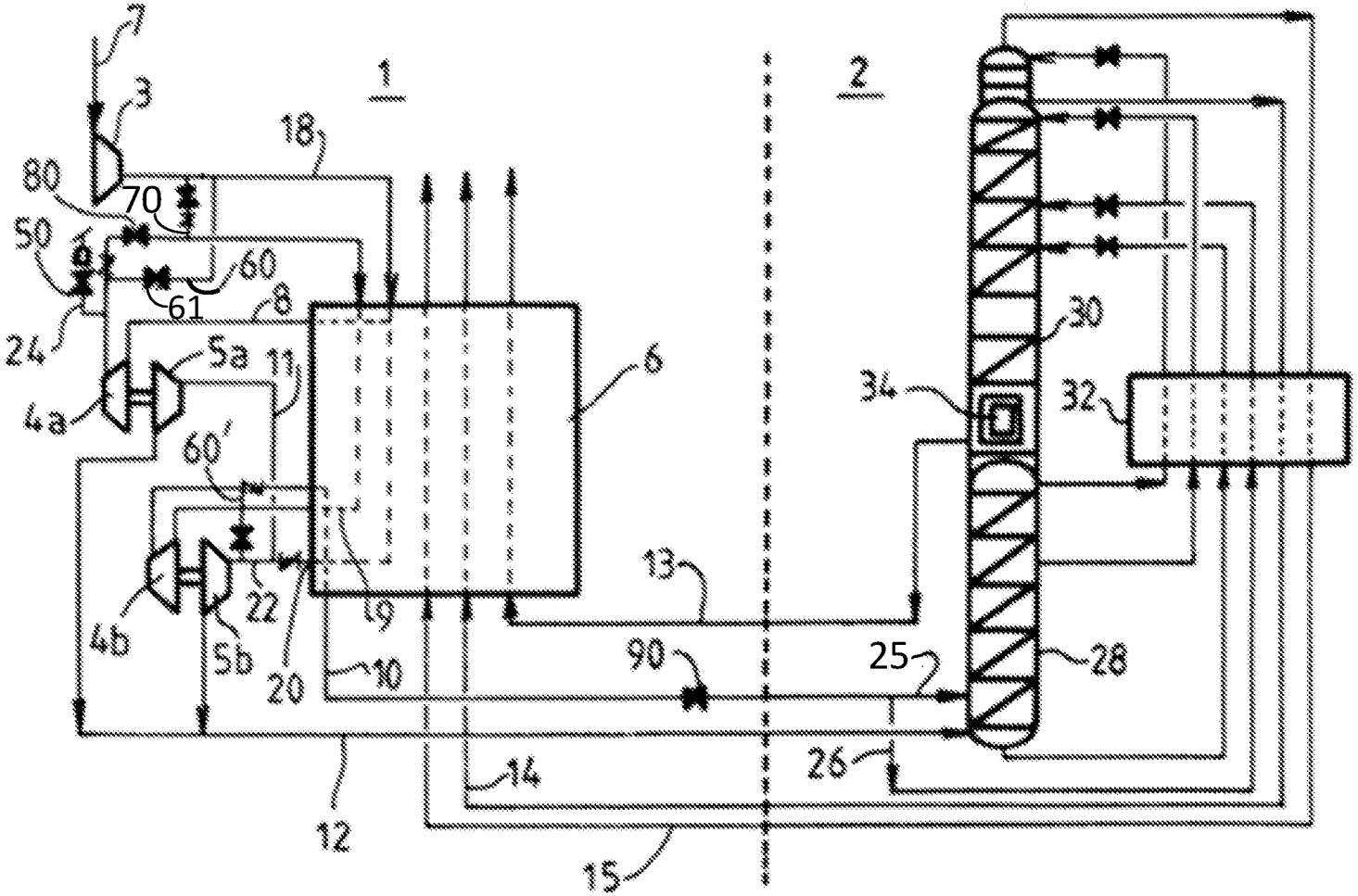
1
2
3
4a
4b
5a
5b
6
7
8
9
10
11
12
13
14
15
18
19
20
21
22
24
25
26
28
30
32
34
50
60
60'
61
70
80
90

METHOD FOR STARTING UP A CRYOGENIC AIR SEPARATION UNIT AND ASSOCIATED AIR SEPARATION UNIT

CROSS REFERENCE TO RELATED APPLICATIONS

This application is a § 371 of International PCT Application PCT/CN2018/122047, filed Dec. 19, 2018, which is herein incorporated by reference in its entirety.

FIELD OF THE INVENTION

The present invention relates to a method for starting up a cryogenic air separation unit and to an associated air separation unit.

In particular, it may apply to an air separation unit (ASU) having a booster which compresses air which has been compressed and then cooled in a main heat exchanger and is subsequently cooled after compression in the booster and sent to the column system or to a turbine, coupled to the booster.

BACKGROUND OF THE INVENTION

In an air separation unit, the feed air is compressed cooled, distilled in a column system and the gaseous and/or liquid products of the column system are warmed. The warming of the products and the cooling of the feed air generally take place in a main heat exchanger, having an entry temperature at the warm end above 0° C.

In some plants, which may have little or no liquid production, air can be compressed in a main air compressor and part of the air is then further compressed in a compressor called a booster. The air from the booster is generally cooled in a separate heat exchanger before being sent to the main heat exchanger in which the products of the air separation unit are warmed.

Eliminating this separate heat exchanger, called a turbine booster aftercooler, saves the cost of the heat exchanger and also allows compression power to be reduced, since the pressure drop in the separate heat exchanger is eliminated.

However it poses some problems when the air separation unit is started up from a warm condition, for example, when the unit has been closed down for maintenance or for an initial start-up.

These include:

a. Inability to remove heat from the ASU system
b. Risk of booster surge
c. Risk of reverse rotation of the booster
d. Risk of main heat exchanger damage due to high gas temperature coming from the turbine booster

SUMMARY OF THE INVENTION

In certain embodiments, t invention may include a method which reduces at least one of these risks when starting the ASU from a warm state using a venting conduit to release heat from the system to produce cold.

According to one object of the invention, there is provided a process for starting up an air separation unit which is at a temperature of above 0° C., the air separation unit comprising a main air compressor for compressing the feed air, a main heat exchanger, a conduit for sending compressed air from the main air compressor to the main heat exchanger to be cooled, a booster, a conduit for sending at least part of the compressed air cooled in the main heat exchanger to the booster, means for sending air to the main heat exchanger from the booster, there being no means for cooling the air downstream of the booster and upstream of the main heat exchanger, a column system, at least one turbine connected to receive compressed air from the main air compressor and possibly from the booster, the at least one turbine being connected to the column system to provide air to be distilled in the column system, a conduit from removing an oxygen enriched product from the column system and sending it to be warmed in the main heat exchanger, a conduit from removing an nitrogen enriched product from the column system and sending it to be warmed in the main heat exchanger wherein in normal operation, air is sent from the main air compressor to the heat exchanger, cooled in the heat exchanger, compressed in the booster, cooled in the heat exchanger and separated in the column system, air is sent form the heat exchanger to be expanded in the turbine and is separated in the column system and a nitrogen enriched product and an oxygen enriched product are warmed in the heat exchanger wherein the air separation unit comprises a venting conduit connected downstream of the booster and upstream of the main heat exchanger and in that in order to start up the air separation unit, i) air is compressed in the main air compressor and sent to the booster inlet
ii) air is sent to the turbine inlet and
iii) before the turbine is operating at a given fraction of its critical speed, the venting conduit remains closed and once the turbine is operating at said given fraction or above, the venting conduit is opened to send at least part of the air compressed in the booster from the booster outlet to the atmosphere.

According to further optional features:

in normal operation, a first air stream is sent from the booster to a second booster and a second air stream is sent from the main heat exchanger to the turbine and during start up, air is sent to the booster and is sent to the turbine via a by-pass conduit.

during at least part of the start up, no air is sent to the second booster.

during start up, whilst air is compressed in the main air compressor and then sent to the booster inlet, air is sent to the turbine and the venting conduit is open whilst the turbine is operating at at least said given fraction of its critical speed, the main heat exchanger cools down and if a temperature within the main heat exchanger is detected to be below a given threshold, the venting conduit is closed progressively.

the booster outlet temperature downstream the booster and upstream of the main heat exchanger is detected and whilst air is compressed in the main air compressor and then sent to the booster inlet, air is sent to the turbine and the venting conduit is at least partially open if the booster outlet temperature is above a given temperature and the venting conduit is closed completely if the booster outlet temperature is below the given temperature.

the air separation unit comprises a bypass conduit for sending air directly from the booster to an airstream compressed in the main air compressor, preferably only in the main air compressor, without passing via the main heat exchanger.

in step i) air is compressed in the main air compressor and mixed with air from the booster outlet via the bypass conduit.

in normal operation air from the booster is sent to the main heat exchanger without being mixed with another airstream.

during start up, the booster outlet temperature downstream the booster and upstream of the main heat exchanger is detected, air is compressed in the main air compressor, sent to the booster inlet, air is sent to the turbine and i) the bypass conduit to send air from the booster to be mixed with air from the main air compressor without passing through the main heat exchanger is at least partially open if the booster outlet temperature is above a given temperature and ii) the bypass conduit is closed completely and air is sent from the booster to the main heat exchanger without being mixed with another air stream, if the booster outlet temperature is below the given temperature.

in normal operation, liquefied air is sent to the column system, which has preferably been compressed in the booster and a liquid product from the column system is vaporized in the heat exchanger.

during the start-up process, i) initially no liquid product from the column system is vaporized in the heat exchanger and no liquefied air is sent to the column system, and ii) subsequently, a liquid product is withdrawn from the column system and vaporized in the heat exchanger and liquefied air is sent to the column system.

during start-up, the venting line may remain open until a certain amount of liquid is stored in at least one column of the column system.

According to a further object of the invention, there is provided an air separation unit, comprising a main air compressor for compressing the feed air, a main heat exchanger, a conduit for sending compressed air from the main air compressor to the main heat exchanger to be cooled, a booster, a conduit for sending at least part of the compressed air cooled in the main heat exchanger to the booster, means for sending air to the main heat exchanger from the booster, there being no means for cooling the air downstream of the booster and upstream of the main heat exchanger, a column system, at least one turbine connected to receive compressed air from the main air compressor and possibly from the booster, the at least one turbine being connected to the column system to provide air to be distilled in the column system, a conduit from removing an oxygen enriched product from the column system and sending it to be warmed in the main heat exchanger, a conduit from removing an nitrogen enriched product from the column system and sending it to be warmed in the main heat exchanger characterised in that the air separation unit comprises a venting conduit connected downstream of the booster and upstream of the main heat exchanger.

The unit preferably includes a conduit for sending air from the booster to the conduit for sending compressed air from the main air compressor to the main heat exchanger to be cooled.

The unit may include a device for detecting the outlet temperature of the booster and controlling the opening of a valve to send air compressed in the booster to be mixed with an airstream compressed in the main air compressor as a function of the outlet temperature of the booster.

Preferably the booster is driven by the least one turbine.

The unit may comprise means for detecting the speed of the at least one turbine and for opening the venting conduit once the turbine reaches a given speed.

The unit may comprise means for detecting the outlet temperature of the booster and for opening a valve to allow air to flow directly from the booster to the main heat exchanger without being mixed with another air stream once the outlet temperature is below a given value.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims the way in which said claims refer back to one another.

FIG. 1 provides an embodiment of the present invention.

DETAILED DESCRIPTION OF THE INVENTION

The invention will now be described in detail with reference to FIG. 1, which shows an air separation unit in which this start-up process can be applied.

In FIG. 1, the air separation unit comprises a double column, having a first column 28 operating at a first pressure and a second column 30 operating at a second pressure, lower than the first pressure and slightly above atmospheric pressure. The refrigeration production section 1 includes a series of compressors and turbines as well as a main heat exchanger 6. The distillation section 2 includes the columns 28, 30, a reboiler 34 and a subcooler 32.

In normal operation, air 7 is sent to a main air compressor 3 in which air is compressed to a pressure above the pressure of the first column 28. Part of the air 18 is cooled in the main heat exchanger 6 and divided in two. One part 8 of the air is removed at a temperature just below that of the warm end of the heat exchanger 6 and is compressed in a cool booster 4*a*. The term "cool booster" is used since the air has simply been slightly cooled in the heat exchanger 6. All the boosted air is then sent back to the warm end, without having been cooled, is then cooled in the main heat exchanger 6 to an intermediate temperature and sent as stream 9 to a second booster 4*b* which is designated as a cold booster, since the air arriving in the booster is significantly colder than that arriving in booster 4*a*. The air from cold booster 4*b* is sent back to the main heat exchanger 6, cooled to the cold end temperature, removed as stream 10, expanded and send as liquefied stream 25 to the first column 28 and as liquefied stream 26 to the second column 30.

The rest 20 of stream 18 is cooled to a temperature lower than the inlet temperature of the cold booster 4*b* and expanded in turbines 5*a* and 5*b* as parallel streams 11, 22. The cool booster 4*a* is driven by turbine 5*a* and the cold booster 4*b* is driven by turbine 5*b*. The expanded air streams from the turbines 5*a*, 5*b* are mixed to form stream 12 and sent as gaseous feed to the first column.

Oxygen enriched liquid and nitrogen enriched liquid are sent from the first column to the second column in the usual way.

A nitrogen enriched gaseous stream 15 is removed from a minaret at the top of the second column 30 and warmed in exchanger 6. Liquid oxygen 13 is removed close to the bottom reboiler 34 of the second column 30 and vaporised in the exchanger 6.

A nitrogen enriched gaseous stream 14 is removed from the top of the second column 30 and warmed in exchanger 6.

It will be appreciated that in normal operation, none of the boosted air from either booster 4*a* or 4*b* is sent to a turbine.

In order to start up the air separation unit, in a basic version of the start-up process, valve 80 is used to isolate the high pressure air from cool booster 4*a* and allow the bypass air from main air compressor 3 to go to the inlet of cold booster 4*b* for initial start up.

When the unit required to start up whilst being at a temperature above 0° C., air is compressed in main air compressor 3 and is sent to the main heat exchanger, but in warm condition there is no cold stream 13,14,15 from the coldbox to cool down this air. So the air is sent to the inlet of cool booster 4*a* in warm condition. At the same time, air is sent to turbines 5*a* and 5*b*. Air 9 from main air compressor 3 is sent to cold booster 4*b* via bypass conduit 70.

Once the turbine 5*a* is functioning at a speed higher than its no-dwell zones, corresponding to a range of speeds around a critical speed or speeds, the venting valve 50 is opened to release boosted air from booster 4*a* to the atmosphere via venting conduit 24. Part of the air from booster 4*a* is released to the atmosphere via conduit 24, however the rest of the air is sent via conduit 60 to join air stream 18. Valve 80 is closed.

Air is sent from the turbine 5*a* to the column 28 and begins to be separated in the column.

If this venting conduit 24 is opened by opening the venting valve 50 before flow is introduced to the cool booster turbine 5*a*, the cool booster turbine could begin to rotate, which could damage the machine. This valve should therefore remain closed before cool booster turbine is started. Additionally, this venting valve should be fail closed to ensure that the machine does not rotate while the plant is shutdown.

Because this turbine booster 4*a* has no aftercooler, the hot air downstream the turbine booster cannot be introduced into the suction of the booster 4*a* or the inlet of the turbine 5*a*, which will make the surge worse. So here an anti-surge line 60 is installed from booster discharge to the air conduit upstream the main heat exchanger 6. This allows the air from the booster 4*a* to be mixed with the main feed air 18 from compressor 3. Because the boosted air is reduced in quantity and is mixed with another cooler stream, stream 18, the risk of damaging the heat exchanger is reduced.

In order to prevent the trip of the main heat exchanger, we need to open the venting line 24 as soon as possible, immediately after turbine has passed the no-dwell zone (if a no dwell zone exists).

For this basic variant, independent start-up of the turbines is not possible due to an incompatibility of flow between the cold booster and its turbine.

In a basic version of the invention, during start-up, the air from cool booster 4*a* is sent either to the atmosphere or to the turbine 5*a*. None of the air from the cool booster 4*a* is sent to the cold booster 4*b* during at least part of the start-up process. During at least part of the start up process, any air which is boosted in booster 4*a* and which is not sent to the atmosphere, is sent to turbine 5*a* and/or turbine 5*b*.

Ideally it is desired to startup the cool booster 4*a* simultaneously with the cold booster 4*b*. In this case a bypass line 70 is used to have the incoming air for cold booster 4*b*, together with an isolation valve 80 after cool booster 4*a*. Additionally, bypass line 70 must be connected in such a way as to avoid a short circuit sending the flow from anti surge line 60 directly to the main heat exchanger 6.

Warm Startup steps:

a. Before starting the turbines, open anti-surge lines 60, 60' for cool booster 4*a* and cold booster 4*b*; close venting conduit 24; close liquid air valve 90; close isolation valve 80 after cool booster 4*a*; open bypass line 70.
b. Start-up cool booster 4*a* and turbine 5*a* and cold booster 4*b* and turbine 5*b* simultaneously
c. As soon as the turbine booster passes the no-dwell zone, open the venting line 24
d. As the temperature in the main heat exchanger cools down, gradually close the venting line. However, note that this is the primary source of refrigeration for the ASU until other equipment capable of extracting work from the system is started.
e. When the temperature at the discharge of the cool booster 4*a* decreases to around 40° C., we can gradually open the isolation valve 80 after the cool booster, and close the bypass line 70. This allows air from booster 4*a* to flow via valve 80 to the heat exchanger 6, line 70 being closed.
f. Once the cold liquid 13 (LOX or LIN) is sent into the main exchanger 6, the liquid valve 90 for liquid air could be opened.

Before the temperature in main heat exchanger 6 is sufficiently low, the air from the cool booster 4*a* is either sent entirely to the atmosphere or else sent in part to the atmosphere and in part to turbines. None of the air is sent to the cold booster 4*b* as it is sent in normal operation.

The temperature in the main heat exchanger 6 is detected and when it is cool enough, the venting line 24 and bypass line 70 are closed so that all the boosted air from booster 4*a* goes to the heat exchanger 6 and from there to cold booster 4*b*.

The opening of the venting line 24 is adjusted as a function of the refrigeration needs. It is maintained at least partially open until other equipment that produces cold is started. It may also be maintained partially open to help establish normal liquid inventories in the cold box. Once isolation valve 80 is open, some of the flow from the cool booster 4*a* will be sent to the heat exchanger and cold booster There is no need to bypass air through valve 70 once the discharge temperature of the cool booster 4*a* is cold enough to send the air directly the heat exchanger.

The anti-surge line 60' sends air from the cold booster 4*b* to the inlet of the turbine 5*b* without passing through the heat exchanger if the booster outlet temperature is too high.

The apparatus may also include:

a device for detecting the outlet temperature of the booster 4*a* and controlling the opening of a valve 61 to send air compressed in the booster 4*a* to be mixed with an airstream 18 compressed in the main air compressor 3 as a function of the outlet temperature of the booster.

means for detecting the speed of the at least one turbine 5*a* and for opening the venting conduit 24 once the turbine reaches a given speed.

means for detecting the outlet temperature of the booster 4*a* and for opening a valve 80 to allow air to flow directly from the booster to the main heat exchanger 6 without being mixed with another air stream once the outlet temperature is below a given value.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for starting up an air separation unit which is at a temperature of above 0° C., the air separation unit comprising:

a main air compressor for compressing a feed air, a main heat exchanger, a conduit for sending compressed air from the main air compressor to the main heat exchanger to be cooled, a booster, a conduit for sending at least part of the compressed air cooled in the main heat exchanger to the booster, means for sending air to the main heat exchanger from the booster, there being no means for cooling the air downstream of the booster and upstream of the main heat exchanger, a column system, at least one turbine connected to receive compressed air from the main air compressor, the at least one turbine being connected to the column system to provide air to be distilled in the column system, a conduit for removing an oxygen enriched product from the column system and sending the oxygen enriched product to be warmed in the main heat exchanger, a conduit for removing a nitrogen enriched product from the column system and sending the nitrogen enriched product to be warmed in the main heat exchanger;

wherein, during normal operation, the air separation unit is configured such that air is sent from the main air compressor to the main heat exchanger, cooled in the main heat exchanger, compressed in the booster, cooled in the main heat exchanger and separated in the column system, air is sent from the main heat exchanger, expanded in the turbine and separated in the column system, and the nitrogen enriched product and the oxygen enriched product are warmed in the main heat exchanger;

wherein the air separation unit comprises a venting conduit connected downstream of the booster and upstream of the main heat exchanger, inlet;

wherein, during start-up of the air separation unit, the method comprises the steps of:

i) compressing air in the main air compressor and then sending said air to a booster inlet;

ii) sending air to a turbine inlet; and iii) biasing the venting conduit to a closed position before the turbine is operating at a given fraction of its critical speed, and once the turbine is operating at said given fraction or above, opening the venting conduit to send at least part of the air compressed in the booster from a booster outlet to an atmosphere.

2. The process according to claim 1, wherein in normal operation, a first air stream is sent from the booster to a second booster and a second air stream is sent from the main heat exchanger to the turbine and during start up, air is sent to the booster and is sent to the turbine via a by-pass conduit.

3. The process according to claim 2, wherein during at least part of the start-up, no air is sent to the second booster.

4. The process according to claim 1, wherein during start up, whilst air is compressed in the main air compressor and then sent to the booster inlet, air is sent to the turbine and the venting conduit is open whilst the turbine is operating at at least said given fraction of its critical speed, the main heat exchanger cools down and if a temperature within the main heat exchanger is detected to be below a given threshold, the venting conduit is closed progressively.

5. The process according to claim 1, wherein a booster outlet temperature downstream the booster and upstream of the main heat exchanger is detected and whilst air is compressed in the main air compressor and then sent to the booster inlet, air is sent to the turbine and the venting conduit is at least partially open if the booster outlet temperature is above a given temperature and the venting conduit is closed completely if the booster outlet temperature is below the given temperature.

6. The process according to claim 1, wherein the air separation unit comprises a bypass conduit for sending air directly from the booster to an airstream compressed in the main air compressor without passing via the main heat exchanger and in step i) air is compressed in the main air compressor and mixed with air from the booster outlet via the bypass conduit.

7. The process according to claim 6, wherein during start up, a booster outlet temperature downstream the booster and upstream of the main heat exchanger is detected, air is compressed in the main air compressor, sent to the booster inlet, air is sent to the turbine and i) the bypass conduit to send air from the booster to be mixed with air from the main air compressor without passing through the main heat exchanger is at least partially open if the booster outlet temperature is above a given temperature and ii) the bypass conduit is closed completely and air is sent from the booster to the main heat exchanger without being mixed with another air stream, if the booster outlet temperature is below the given temperature.

8. The process according to claim 1, wherein in normal operation, liquefied air is sent to the column system and a liquid product from the column system is vaporized in the main heat exchanger.

9. The process according to claim 1, wherein during the start-up process, i) initially no liquid product from the column system is vaporized in the main heat exchanger and no liquefied air is sent to the column system, and ii) subsequently, a liquid product is withdrawn from the column system and vaporized in the main heat exchanger and liquefied air is sent to the column system.

* * * * *